US008784152B2

(12) United States Patent
Busse

(10) Patent No.: US 8,784,152 B2
(45) Date of Patent: Jul. 22, 2014

(54) AERODYNAMIC FLYING DISC

(75) Inventor: Mark Busse, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 924 days.

(21) Appl. No.: 12/890,686

(22) Filed: Sep. 26, 2010

(65) Prior Publication Data

US 2012/0077409 A1 Mar. 29, 2012

(51) Int. Cl.
*A63H 27/00* (2006.01)
*A63H 33/18* (2006.01)

(52) U.S. Cl.
CPC ..... *A63H 33/18* (2013.01)
USPC ..... 446/46

(58) Field of Classification Search
USPC ..... 446/46–48, 61; 473/588, 589; D21/444
See application file for complete search history.

(56) References Cited

U.S. PATENT DOCUMENTS

| | | | | |
|---|---|---|---|---|
| 1,353,663 | A | 9/1920 | Napier | |
| 1,374,757 | A | 4/1921 | Napier | |
| 3,717,136 | A * | 2/1973 | Gay et al. | 124/21 |
| 3,877,383 | A | 4/1975 | Flatau | |
| 3,951,070 | A | 4/1976 | Flatau et al. | |
| 3,968,783 | A | 7/1976 | Pfotenhauer | |
| 3,982,489 | A | 9/1976 | Flatau et al. | |
| 4,112,612 | A * | 9/1978 | Woods | 446/48 |
| 4,153,252 | A | 5/1979 | Sullivan | |
| 4,170,215 | A * | 10/1979 | Kettlestrings | 124/16 |
| 4,176,843 | A * | 12/1979 | DeWitt, Jr. | 446/46 |
| 4,248,202 | A | 2/1981 | Jaworski et al. | |
| 4,265,454 | A * | 5/1981 | Bayless | 473/591 |
| 4,277,068 | A * | 7/1981 | Sasaki | 473/511 |
| 4,334,385 | A * | 6/1982 | Melin et al. | 446/46 |
| 4,659,320 | A | 4/1987 | Rich et al. | |
| 4,820,230 | A * | 4/1989 | Richards | 446/48 |
| 4,940,441 | A * | 7/1990 | Novinsky | 446/46 |
| 5,020,808 | A * | 6/1991 | Richards | 473/589 |
| 5,050,575 | A * | 9/1991 | Killion | 124/8 |

(Continued)

FOREIGN PATENT DOCUMENTS

WO WO8103433 A1 12/1981

OTHER PUBLICATIONS

European Patent Application No. 11182720.0-2318 Communication with EPO Search Report, including EPO Annex dated Dec. 29, 2011.

*Primary Examiner* — Gene Kim
*Assistant Examiner* — Alyssa Hylinski
(74) *Attorney, Agent, or Firm* — Perry Hoffman

(57) ABSTRACT

A toy projectile that has two parts, a cup shaped inner core having a top wall, an annular wall extending from the top wall to a bead adjacent to a bottom end, and an outer covering being somewhat donut shaped with a central opening, a top end, a bottom end, a lower recess, a curved exterior surface and a chamfer adjacent to the bottom end. The inner core is received in the central opening of the outer covering such that the top wall of the inner core is continuous with the top end of the outer covering. The bottom of the projectile may be open or covered. The projectile includes geometric aspect ratios that provide the projectile with excellent flight characteristics. The ratios are: projectile outer diameter to projectile height between 4:1 to 5.2:1; projectile outer diameter to core outer diameter between 1.20:1 to 1.45 to 1; projectile height to core bead height between 2.3:1 to 3.25:1; outer covering volume to inner core volume between 2.4:1 to 5.8:1; profile radius to projectile height between 0.5:1 to 0.8:1; and chamfer height to chamfer width between 2:1 to 6.1.

20 Claims, 4 Drawing Sheets

(56) References Cited

U.S. PATENT DOCUMENTS

| | | | | | |
|---|---|---|---|---|---|
| 5,366,403 | A | * | 11/1994 | Weiss | 446/46 |
| 5,471,967 | A | | 12/1995 | Matsuzaki et al. | |
| 5,611,322 | A | | 3/1997 | Matsuzaki et al. | |
| 5,630,742 | A | * | 5/1997 | Honaker | 446/46 |
| 5,782,228 | A | * | 7/1998 | Wu | 124/6 |
| 5,803,459 | A | * | 9/1998 | Casas-Salat | 273/288 |
| 5,996,564 | A | * | 12/1999 | Kotowski | 124/6 |
| 6,174,214 | B1 | * | 1/2001 | Cooper | 446/46 |
| 6,224,457 | B1 | | 5/2001 | Wu | |
| 6,733,356 | B2 | | 5/2004 | Lee | |
| 7,108,576 | B2 | * | 9/2006 | LaPointe | 446/47 |
| 7,673,624 | B2 | * | 3/2010 | Rosella, Jr. | 124/10 |
| 2004/0166764 | A1 | * | 8/2004 | Stark | 446/46 |
| 2005/0260918 | A1 | * | 11/2005 | LaPointe | 446/47 |
| 2009/0176435 | A1 | | 7/2009 | Stark | |
| 2009/0176436 | A1 | * | 7/2009 | Stark | 446/46 |
| 2010/0279579 | A1 | * | 11/2010 | Michelsen et al. | 446/46 |

* cited by examiner

| GEOMETRIC ASPECT RATIOS |
| --- |
| "Projectile O. D. : Projectile Height" 4:1 to 5:2:1 |
| "Projectile O. D. : Core O. D." - 1.20:1 to 1.45:1 |
| "Projectile Height : Core Bead Height" - 2.3:1 to 3.25:1 |
| "Covering Volume : Core Volume " - 2.4:1 to 5.8:1 |
| "Profile Radius : Projectile Height" - 0.5:1 to 0.8:1 |
| "Chamfer Height : Chamfer Width" - 2:1 to 6:1 |

AERODYNAMIC FLYING DISC

FIELD OF THE INVENTION

The present invention relates generally to aerodynamic flying disc toy projectiles, and, more particularly, to a toy projectile in the form of a Frisbee-like circular disc that may be discharged from a toy launcher apparatus.

BACKGROUND OF THE INVENTION

Toy projectile come in many shapes and forms in an effort to generate play value. Disc devises are captivating because of the floating-like movement such devices have after being discharged from a launching device, the Frisbee being one of the most well known of such devices where the launching device is a thrower's arm. New approaches to disc designs are constantly being made often without success.

Disc devices are well known and are disclosed in the following patents. By way of example, U.S. Pat. No. 4,153,252 for an "Aerodynamic Disc" issued in 1979 to Sullivan, and purports to disclose a disc with a toroidal rim section and a central section where a substantial amount of weight of magnetic material is placed in a effort to achieve enhanced rotational spin of the disc. U.S. Pat. No. 4,820,230 for a "Tossing Ring And Saucer" issued in 1989 to Richards, and purports to disclose a tossing ring of foam material with a number of mitered surfaces to give the ring a particular flight characteristic, namely less distance and a more vertical descent. In one embodiment, an insert of rigid plastic material is threaded into the center of the ring. A year later another U.S. Pat. No. 4,940,441 for an "Aerodynamic Flying Disc With Weighted Insert" issued to Novinsky, and purports to disclose a disc with a central portion and a perimeter portion. An insert is threadedly engaged with the disc in the central portion and the insert is embossed or imprinted with words or logos.

In 1998 a U.S. Pat. No. 5,782,228 issued to Wu for a "Toy Flying Disk And Launcher System" that purports to disclose a disk formed from a slat disk body having a center hole and two end caps fastened together through the center hole. The disk body may be molded of flexible material while the end caps are molded from rigid plastic. The end caps have smoothly curved outer surfaces to reduce friction between disks when they are in contact with one another in a magazine. (Note that the spellings of "disc" and "disk" have been adopted as the word is used in the referenced patents.) U.S. Patent Application Publication 2009/0176435 for a "Flexible Flying Disc" was published in 2009 listing Stark as inventor, and purports to disclose a toy disc with a recess formed by an upstanding edge connected to a bottom structure. A stabilizing member is inserted into the recess in some of the embodiments shown. The outer disc is made of a soft, pliant and flexible material.

These patents and devices are of some interest, however, they do not disclose or illustrate a superior marketable toy item.

SUMMARY OF THE INVENTION

In accordance with the present invention, an advantageous method and apparatus are provided in the form of an aerodynamic flying disc or toy projectile having a soft exterior and a more robust interior. The soft exterior reduces the risk of injury or damage. The more robust interior allows the use of a launcher device which impacts the interior of the toy projectile to provide energy for discharge and flight. The toy projectile includes specific geometric ratios of certain dimensions and is structure such that flight is extended and flight characteristics are improved. The projectile may be used with different types of launchers and the bottom of the projectile may be open or closed.

The toy projectile is lightweight, having good flight characteristics, safe, yet strong, easy to use and handle, inexpensive, compact and structurally robust.

Briefly summarized, the invention relates to a toy projectile including a circular outer covering formed of a first soft material, the outer covering including an central opening, an annular recess, a top end, a bottom end, a curved radial exterior surface, and a chamfer, the annular recess being located adjacent to the bottom end in the central opening of the outer covering and the chamfer located on the exterior surface adjacent to the bottom end, and a circular inner core formed of a second material, the inner core having a closed top end and an open bottom end, and an enlarged bead formed adjacent to the bottom end, wherein the inner core is positioned in the central opening of the outer covering and the enlarged bead is positioned in the annular recess.

The invention also relates to a method for manufacturing a circular toy projectile including the steps of molding an inner core of a first material, the inner core having a wall with an inner surface and an enlarged bead adjacent to one end, molding an outer covering of a soft second material, the outer covering having a central opening and an annular recess adjacent to one end, and mounting the inner core within the central opening of the outer covering and mounting the bead within the outer covering annular recess.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

Figure 1:
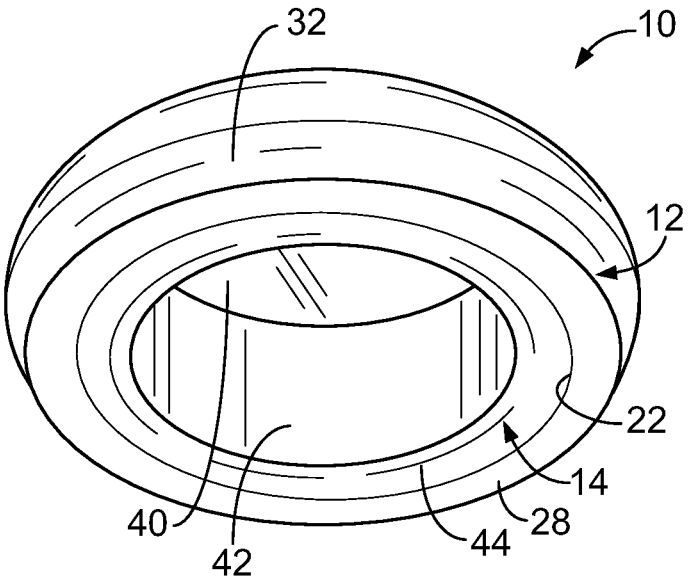
FIG. 1 is an upward looking isometric view of a preferred embodiment of the present invention in the form of a toy projectile having a circular shape.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring now to the Figures, FIGS. 1-5, there is shown two embodiments of the aerodynamic flying disc invention in the form of a toy projectile apparatus 10. The covered circular disc or toy projectile includes an outer covering 12 and an inner core 14 providing a soft exterior with somewhat robust interior for good flight characteristics. The toy projectile is structured to be discharged from a toy launcher apparatus 15, such as that shown in FIG. 7, where discharge energy is imparted to the toy projectile through a brief, but sharp impact at a relatively small contact area at the toy projectile generating good flight characteristics and distance. In the alternative, an electrically driven device similar to a baseball pitching machine, namely a machine using two or more rotating wheels, may be used to impart energy to the toy projectile by engaging predetermined regions of the outer surface of the toy projectile. Other types of discharging devices may also be used to discharge or "shoot" the toy projectile, such as ones based on a sling or a catapult.

The outer covering 12 is generally toroidal shaped, approximating a donut, but specifically shaped as shown in the figures of the drawings. The outer covering has an central opening 20, FIG. 6, surrounded by an annular wall 22, a curved exterior surface 24 when viewed in a radial direction with a profile radius as identified in FIG. 6, a top end 26, a bottom end 28, a lower annular recess 30 located in the central opening annular wall 22 adjacent to the bottom end 28 as shown, and a chamfer 32 located on the exterior surface also adjacent to the bottom end 28 as shown.

Figure 3:
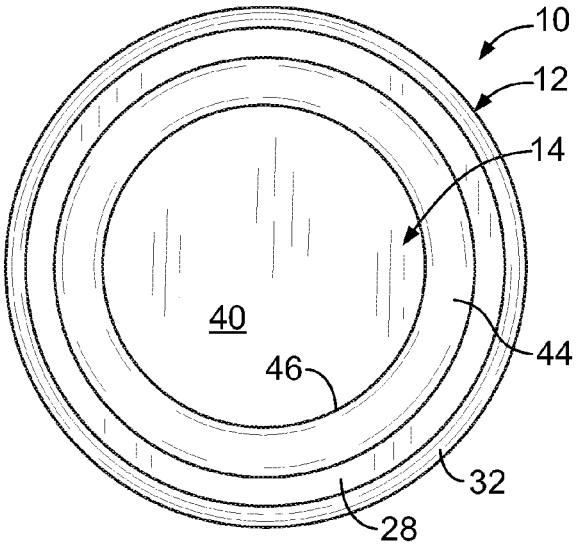
FIG. 3 is a bottom plan of the toy projectile shown in FIGS. 1 and 2.
Figure 4:
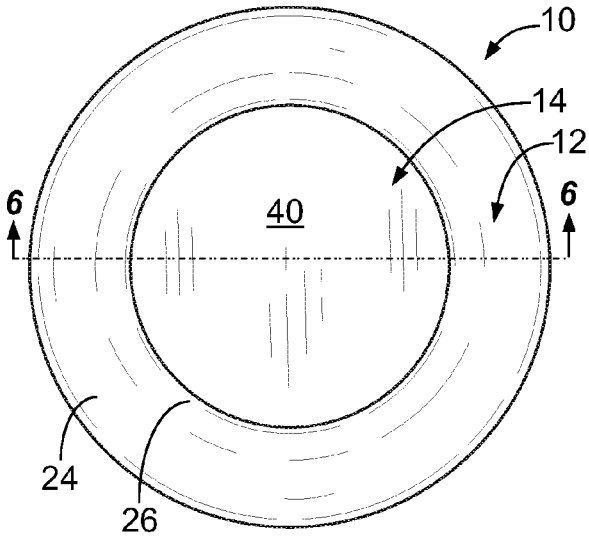
FIG. 4 is a top plan view of the toy projectile shown in FIGS. 1-3.
Figure 6:
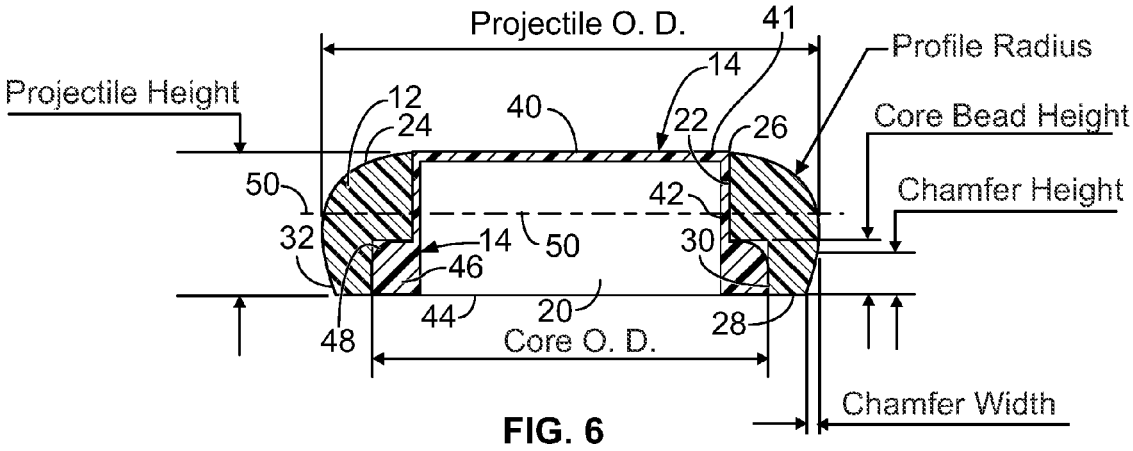
FIG. 6 is a cross sectional view taken along line 6-6 of FIG. 4.

The inner core 14 is generally cup shaped, having a wall 40 at a top end 41 of the inner core, an annular sidewall 42, an open bottom end 44, and an enlarged bead 46 integral with the annular side wall 42 and forming a border around and adjacent to the bottom end 44 as shown. The sidewall 42 is integral with and extends from the top end wall 40 to the bead 46 at the bottom end 44. The inner core has a circular shape in plan view as seen in FIG. 3 and mates with the outer covering as shown in FIG. 6.

The inner core 12 is positioned in the central opening 20 of the outer covering 14 such that the annular wall 22 of the outer covering and the annular sidewall 42 of the inner core adjoin one another, and the annular recess 30 of the outer covering receives the enlarged bead 46 of the inner core. Thus it may be seen that the outer geometry of the inner core conforms generally to the inner geometry of the outer covering except that the outer radial surface 48 of the bead 46 is rounded as shown in FIG. 6. A suitable adhesive, well known in the art, may be used to fasten the inner core 14 to the outer covering 12. The top wall 40 of the inner core closes the top end 26 of the central opening 20 of the outer covering.

The outer covering is made of soft, compliant and resilient material such as the soft foam products that are marketed under the brand name NERF. A preferred material here is a blend of EVA (ethylene vinyl acetate) and PU (polyurethane). The soft foam has a density range of about 0.035 g/cm$^3$ to 0.088 g/cm$^3$. The outer covering made of soft foam acts as a safety feature to prevent injury to children and others during play with the toy projectile and to prevent damage to furnishings.

The inner core may be made of any suitable resin material such as EVA 8450, ABS (acrylonitrile butadiene styrene), PVC (polyvinyl chloride), a PVC-ABS blend and K-Resin (a trademarked term for styrene butadiene block copolymer). EVA 8450 has a Shore A hardness of about 90, ABS has a Shore D hardness of approximately 65, PVC has a Shore A hardness of approximately 85, the PVC-ABS blend has a Shore A hardness of approximately 85 and the K-Resin brand plastic has a Shore D hardness of approximately 55. The inner core is intended to be sufficiently strong so as to withstand and resist injury from an impact of a launch arm as will be explained in more detail below.

Figure 7:
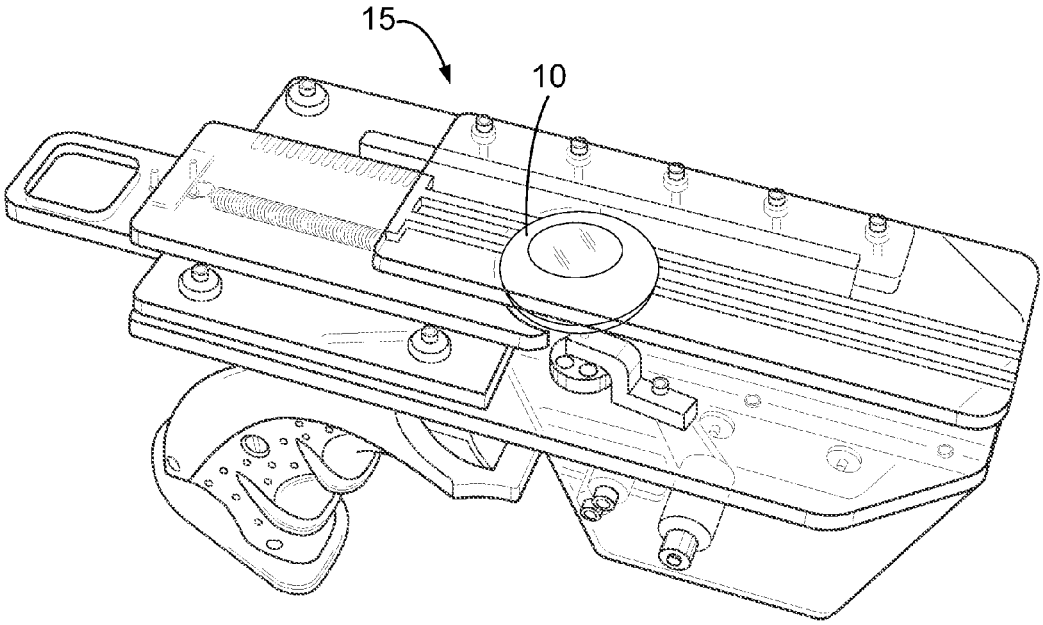
FIG. 7 is an isometric view of a toy launcher apparatus of the type for launching or discharging the toy projectile.

The toy projectile 10 is designed in size so as to cooperate with the toy launcher apparatus shown in FIG. 7, where the toy projectile has an outer diameter of about 40 mm. As defined in FIG. 6, the toy projectile has a bead or core outer diameter of about 32.5 mm and a bead height of about 4 mm. The inner core also has an outside diameter of the sidewall 42 of about 25.3 mm, and an inner diameter of the sidewall 42 of about 24.3 mm. The toy projectile is about 9.60 mm in height, and the outer covering has a height of about 9.25 mm. The profile radius is about 6.25 mm, the outer covering volume is about 4429 mm$^3$ and the inner core has a volume of about 1845 mm$^3$. The chamfer is about 2.01 mm in height and about 0.46 mm in width. The toy projectile may, in the alternative, have a larger or smaller diameter and corresponding larger or smaller dimensions, if desired, or the dimensions may be a function of the size or structure of the launcher to be used.

Figure 2:
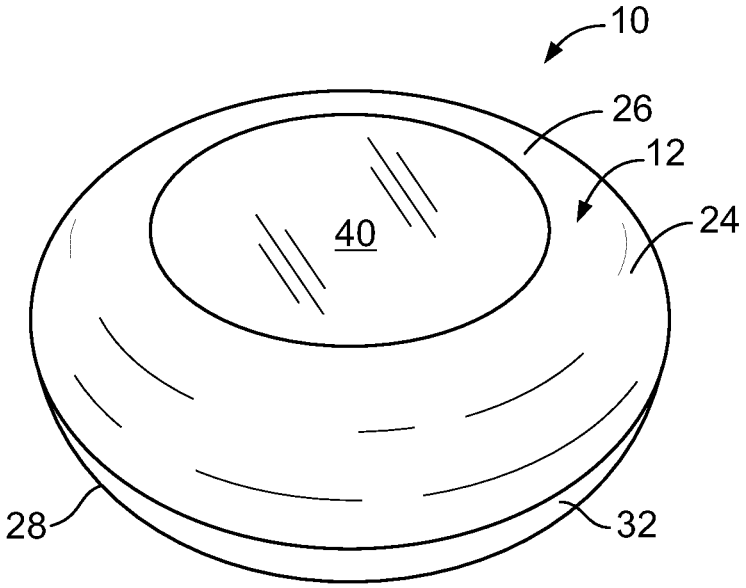
FIG. 2 is a downward looking isometric view of the toy projectile shown in FIG. 1.
Figure 5:
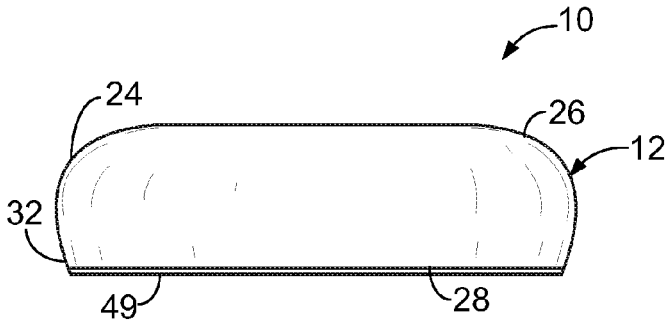
FIG. 5 is side elevation view of the toy projectile shown in FIGS. 1-5, but with a tape covering the bottom of the toy projectile.

It is noted that for best flight characteristics, the top surface 26 of the outer covering and the top wall 40 of the inner core, as shown in the drawings, such as in FIG. 2, are continuous with no openings, whereas the bottom of the projectile is formed by the bottom end 44 of the inner core and is open. In an alternative, tape or another cover may be used to close the opening as shown in FIG. 5, where a piece of tape 49 has been added to the outer covering. When considering volume, seventy percent of the inner core's volume is placed below a plane located midway between the top and bottom ends of the inner core, or at about fifty percent of the toy projectile's height. Stated differently, seventy percent of the inner core's volume is below the plane represented in the drawings by a dashed line 50, drawn in FIG. 6.

Figures 8, 9:
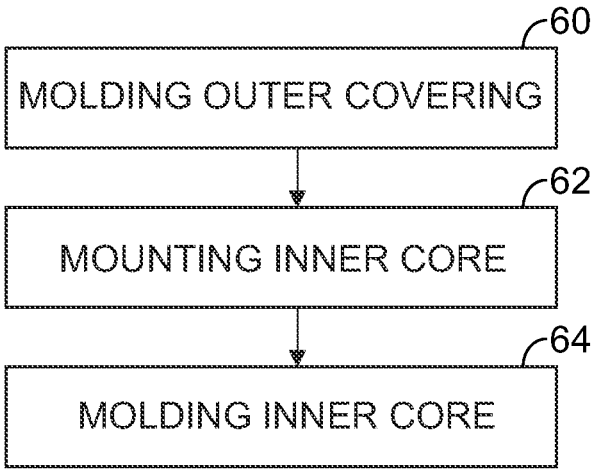
FIG. 8 is a chart illustrating important geometric ratios of the toy projectile structure illustrated in FIGS. 1-6.
FIG. 9 is a flow diagram illustrating a method of manufacturing the toy projectile illustrated in FIGS. 1-6.

Referring now to FIG. 8, geometric aspect ratios are set forth that relate to relationships between various dimensions of the toy projectile as defined in FIG. 6, which are important as they have been determined best for the desired operation of the toy projectile. The projectile outer diameter to projectile height is between 4 to 1 and 5.2 to 1. The projectile outer diameter to the inner core outer diameter is between 1.20 to 1 and 1.45 to 1. The projectile height to the inner core bead height is between 2.3 to 1 and 3.25 to 1. The outer covering volume to the inner core volume is between 2.4 to 1 and 5.8 to 1. The profile radius to the projectile height is between 0.5 to 1 and 0.8 to 1. The chamfer height to the chamfer width is between 2 to 1 and 6 to 1. By best flight characteristics, it is meant that the toy projectile flies further and straighter with the configuration and dimensional ratios disclosed above.

Throughout this disclosure, words such as "top" and "bottom", as well as like terms, refer to portions of the toy projectile as they are viewed in the drawings relative to other portions or in relationship to the positions of the projectile as it will typically be used during play when handled by a user.

In the alternative, different materials for the outer covering and the inner core may be used within the parameters set forth, namely that the outer covering should be soft to prevent injury and damage and the inner core should be strong enough to accept the energy imparted from a launch arm to cause the toy projectile to be discharged.

In operation, the toy projectile may be mounted on a toy launcher apparatus as disclosed in a companion patent application Ser. No. 12/890,689 and shown in FIG. 7. The toy projectile is located such that a launch arm or striker, which is spring activated, strikes the sidewall 42 of the inner core 14 to transfer energy to cause the toy projectile to be discharged from the launcher apparatus. The material of the inner core should be of sufficient strength to handle multiple impacts of the launch arm.

The present invention also includes a method for manufacturing the toy projectile including the steps of molding 60 the cup shaped inner core 14 of a first robust material, the inner core having the side wall 42 with the bead 46 adjacent the bottom end 44, molding 62 the outer covering 12 of a second soft material, the outer covering having the central opening 20 and the annular recess 30 at the bottom end 28, and mounting 64 the inner core 14 within the central opening 20 of the outer covering 12 and mounting the bead 46 of the inner core within the outer covering annular recess 30.

The toy projectile disclosed in detail above has great play value when combined with a toy launcher apparatus, and is fun to use and easy to operate in a safe manner. The projectile is robust, but with a simple structure that may be produced at a reasonable cost.

From the foregoing, it can be seen that there has been provided features for an improved toy projectile that has excellent flight characteristics. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy projectile comprising:

a circular outer covering formed of a first soft foam material, the outer covering including a central opening defined by an annular wall, an annular recess in the annular wall, a top end, a flat bottom end, a curved radial exterior surface, and a chamfer, the annular recess extending from the bottom end in the central opening of the outer covering and the chamfer being located on the exterior surface adjacent to the bottom end; and a circular inner core formed of a second strong resin material, the inner core having an annular sidewall, an integral closed top wall at a top end, an open flat bottom end, and the annular sidewall extending from said bottom end to said closed top wall at the top end with an enlarged bead extending from the bottom end, said second strong resin material being robust compared to said first soft foam material;

wherein the inner core is positioned in the central opening of the outer covering and the annular wall of the outer covering and the annular sidewall of the inner core adjoin one another with the enlarged bead positioned in the annular recess.

2. The toy projectile of claim 1 wherein:

approximately seventy percent of the volume of the inner core is located below a plane located midway between the top and bottom ends of the inner core.

3. The toy projectile of claim 1, wherein:

the inner core annular sidewall extends perpendicular from the bottom end to the closed top end.

4. The toy projectile of claim 1, wherein:

the outer covering annular recess includes a second annular wall extending perpendicular from the bottom end and parallel to the first mentioned annular wall, the first mentioned and second annular walls being connected at right angles by a third wall.

5. The toy projectile of claim 1, wherein:

the top end of the outer covering is closed by the inner core.

6. The toy projectile of claim 1, wherein:

geometric aspect ratios of the projectile include:

projectile outer diameter to projectile height between 4:1 to 5.2:1;

projectile outer diameter to core outer diameter between 1.20:1 to 1.45 to 1;

projectile height to core bead height between 2.3:1 to 3.25:1;

covering volume to core volume between 2.4:1 to 5.8:1;

profile radius to projectile height between 0.5:1 to 0.8:1; and chamfer height to chamfer width between 2:1 to 6.1.

7. The toy projectile of claim 6 wherein:

approximately seventy percent of the volume of the inner core is located below a plane located midway between the top and bottom ends of the inner core.

8. The toy projectile of claim 7, wherein:

the inner core annular sidewall extends perpendicular from the bottom end to the closed top end.

9. The toy projectile of claim 7, wherein:

the outer covering annular recess includes a second annular wall extending perpendicular from the bottom end and parallel to the first mentioned annular wall, the first mentioned and second annular walls being connected at right angles by a third wall.

10. The toy projectile of claim 8, wherein:

the outer covering annular recess includes a second annular wall extending perpendicular from the bottom end and parallel to the first mentioned annular wall, the first mentioned and second annular walls being connected at right angles by a third wall.

11. The toy projectile of claim 6, wherein:

the inner core annular sidewall extends perpendicular from the bottom end to the closed top end.

12. The toy projectile of claim 1 wherein:

the bottom end of the outer covering is closed.

13. A toy projectile comprising:

a generally toroidal shaped outer covering formed of a soft foam material with a central opening surrounded by first and second annular walls having first and second diameters, respectively, a curved exterior surface, a top end, a flat bottom end, the diameter of the first annular wall being larger than the diameter of the second annular wall and the first annular wall extending perpendicular from the bottom end and parallel to the second annular wall; and a circular inner core formed of a strong resin material, the inner core having an integral closed top end at a top end wall, a flat bottom end, an annular sidewall extending perpendicular from the bottom end, and the annular sidewall extending from said bottom end to said closed top end with an enlarged bead extending from the bottom end, said second strong resin material being robust compared to said first soft foam material;

wherein the inner core is positioned in the central opening of the outer covering, the top end wall closes the central opening, the inner core annular side wall adjoins the outer covering second annular wall, and the inner core enlarged bead extends between the first annular wall of the outer covering and the annular side wall of the inner core.

14. The toy projectile of claim 13 wherein:

approximately seventy percent of the volume of the inner core is located below a plane located midway between the top and bottom ends of the inner core.

15. The toy projectile of claim 13, wherein:

geometry aspect ratios of the projectile include projectile outer diameter to projectile height between 4:1 to 5.2:1;

projectile outer diameter to core outer diameter between 1.20:1 to 1.45 to 1;

projectile height to core bead height between 2.3:1 to 3.25:1;

covering volume to core volume between 2.4:1 to 5.8:1;

profile radius to projectile height between 0.5:1 to 0.8:1; and chamfer height to chamfer width between 2:1 to 6.1.

16. The toy projectile of claim 15 wherein:

approximately seventy percent of the volume of the inner core is located below a plane located midway between the top and bottom ends of the inner core.

17. The toy projectile of claim 16 wherein:

the inner core annular sidewall is impact resistant.

18. A method for manufacturing a circular toy projectile comprising the steps of:

molding a circular inner core of a strong material, the inner core having a wall with an inner surface and an enlarged bead extending from a lower end;

molding a circular outer covering of a soft material, the outer covering having a central opening and first and second annular walls of different diameters, the circular inner core strong material being robust compared to the circular outer covering soft material; and mounting the inner core within the central opening of the outer covering, the inner core having an annular sidewall, an integral closed top wall at a top end, and an open flat bottom end with the annular sidewall extending from said bottom end to said closed top wall at the top end mounting the bead adjoining the first annular wall of the outer covering.

19. The method of claim 18 wherein:

the inner core is generally cup shaped with the bead located around an open end and a wall located at an opposite end.

20. The method of claim 19 including the steps of:

forming the toy projectile to have a ratio of projectile outer diameter to projectile height of between 4 to 1 and 5.2 to 1;

forming the toy projectile to have a ratio of projectile outer diameter to inner core outer diameter of between 1.20 to 1 and 1.45 to 1;

forming the toy projectile to have a ratio of projectile height to inner core bead height of between 2.3 to 1 and 3.25 to 1;

forming the toy projectile to have a ratio of covering volume to core volume of between 2.4 to 1 and 5.8 to 1;

forming the toy projectile to have a ratio of profile radius to projectile height of between 0.5 to 1 and 0.8 to 1; and forming the toy projectile to have a ratio of chamfer height to chamfer width of between 2 to 1 and 6 to 1.

* * * * *